US011324262B2

(12) United States Patent
Lien et al.

(10) Patent No.: US 11,324,262 B2
(45) Date of Patent: May 10, 2022

(54) BREAST SUPPORT

(71) Applicants: Yin-Wan Lien, New Taipei (TW); Yueh-Hsia Chiu, New Taipei (TW)

(72) Inventors: Yin-Wan Lien, New Taipei (TW); Yueh-Hsia Chiu, New Taipei (TW)

( * ) Notice: Subject to any disclaimer, the term of this patent is extended or adjusted under 35 U.S.C. 154(b) by 87 days.

(21) Appl. No.: 16/801,454

(22) Filed: Feb. 26, 2020

(65) Prior Publication Data

US 2020/0367575 A1 Nov. 26, 2020

(30) Foreign Application Priority Data

May 22, 2019 (TW) ..... 108206427

(51) Int. Cl.
*A41C 3/06* (2006.01)
*A41C 3/00* (2006.01)

(52) U.S. Cl.
CPC ..... *A41C 3/06* (2013.01); *A41C 3/0007* (2013.01); *A41C 3/0014* (2013.01)

(58) Field of Classification Search
CPC ..... A41C 3/06; A41C 3/007; A41C 3/0014
USPC ..... 450/81
See application file for complete search history.

(56) References Cited

U.S. PATENT DOCUMENTS

2001/0021620 A1* 9/2001 DeMarco ..... A41C 3/0078 450/81
2004/0142630 A1* 7/2004 Lambru ..... A41C 3/06 450/1
2005/0079796 A1* 4/2005 Chou ..... A41C 3/06 450/81
2009/0298386 A1* 12/2009 Deal ..... A41C 3/065 450/81
2019/0261700 A1* 8/2019 Hubbard ..... A41C 3/0007
2020/0367575 A1* 11/2020 Lien ..... A41C 3/06

* cited by examiner

*Primary Examiner* — Gloria M Hale
(74) *Attorney, Agent, or Firm* — Rosenberg, Klein & Lee

(57) ABSTRACT

A breast support has a supporting bracket being elastic, integrally formed as a single part, and having two arc-shaped frame plates. An outer end of each arc-shaped frame plate bends inwardly to form a holding portion. With the breast support, contact area between the breast support and two breasts of a wearer is greatly reduced. Thus, discomfort due to sweltering and sweating can be avoided. Moreover, the breast support is stably mounted on a chest of the wearer and holds lower portions of the two breasts. Therefore, the breast support does not fall from the wearer due to the loss of stickiness. Accordingly, the breast support is able to push the breasts upward and inward and prevents the breasts from expansion and sagging.

20 Claims, 13 Drawing Sheets

BREAST SUPPORT

BACKGROUND OF THE INVENTION

1. Field of the Invention

The present invention relates to a breast support, especially to a breast support that is used for supporting breasts of a wearer.

2. Description of the Prior Art(s)

Most women wear brassiere to protect, support and highlight their breasts. A conventional brassiere has two cup laterally attached to each other, two chest bands extending from side edges of the cups respectively, and two shoulder straps extending from upper edges of the cups respectively and attached to the chest bands respectively. To fit different bodies and to meet different dressing styles, designs of the brassieres have become more diverse. Different styles of brassieres have different effects of pushing the breasts upward and inward, and different coverages on the breasts. Moreover, to avoid the shoulder straps or the chest bands being exposed and affecting clothing collocation, the shoulder straps may be omitted or the shoulder straps and the chest bands may be omitted.

In the strapless and backless brassiere, which is commonly known as "invisible bra", the cups are mainly made of silicone and inner surfaces of the cups are disposed with adhesive. Through the adhesive, the invisible bra is able to be stuck on the breasts of the wearer. However, while wearing the invisible bra, the cups that are made of silicone are closely attached on the breasts. Consequently, after wearing the invisible bra for a while, the breasts of the wearer may break out in an itchy rash due to sweltering and sweating, and the wearer may develop allergies, inflammations, or blisters to the invisible bra, which not only affect the comfort of wearing, but also harm to the wearer's body. Moreover, human skin produces oil more or less, and the oil reduces stickiness of the adhesive, causing the invisible bra falls easily.

To overcome the shortcomings, the present invention provides a breast support to mitigate or obviate the aforementioned problems.

SUMMARY OF THE INVENTION

The main objective of the present invention is to provide a breast support having a supporting bracket. The supporting bracket is elastic- and is integrally formed as a single part. The supporting bracket has two arc-shaped frame plates. Each arc-shaped frame plate has an inner end and an outer end oppositely defined on the arc-shaped frame plate. The inner end of one of the arc-shaped frame plates is integrally connected with the inner end of the other one of the arc-shaped frame plates to form the supporting bracket, and the outer end of each arc-shaped frame plate bends inwardly to form a holding portion.

With the breast support, contact area between the breast support and two breasts of a wearer is greatly reduced. Thus, discomfort due to sweltering and sweating can be avoided. Moreover, the breast support is stably mounted on a chest of the wearer and holds lower portions of the two breasts. Therefore, the breast support does not fall from the wearer due to the loss of stickiness. Accordingly, the breast support is able to push the breasts upward and inward and prevents the breasts from expansion and sagging.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
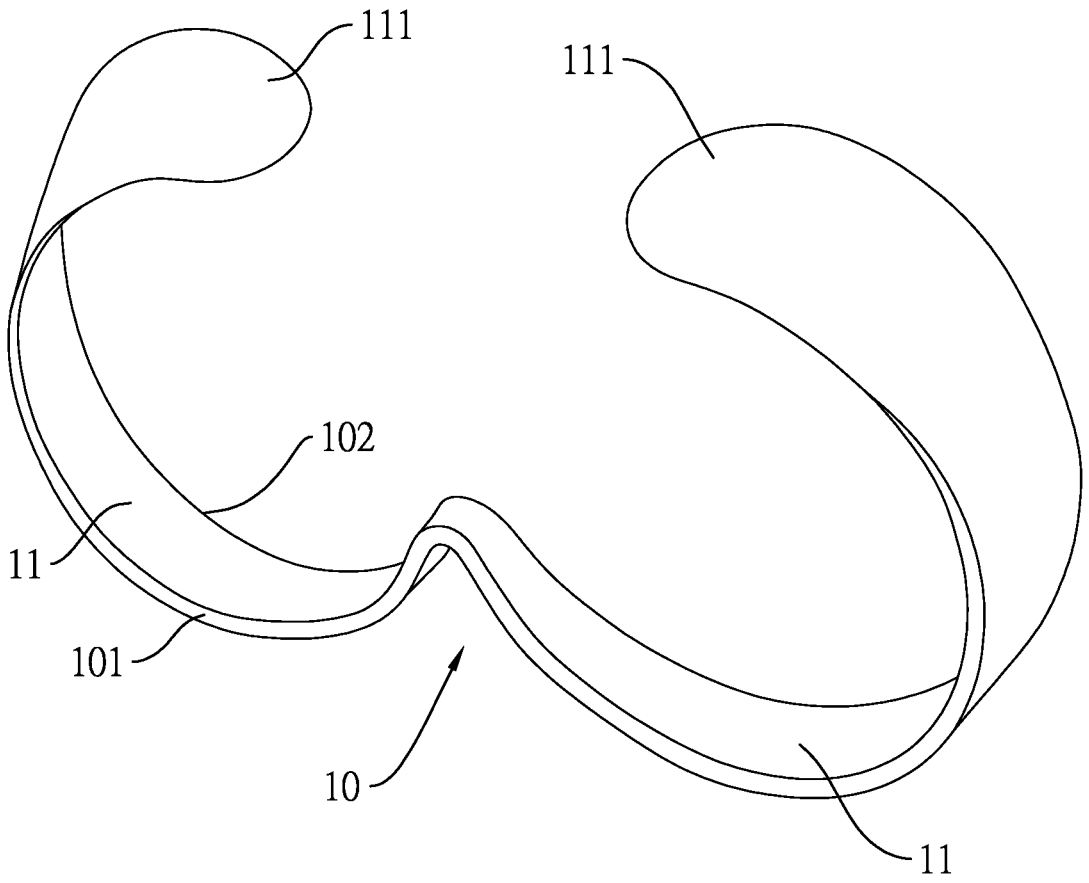
FIG. 1 is a front perspective view of a first preferred embodiment of a breast support in accordance with the present invention.
Figure 2:
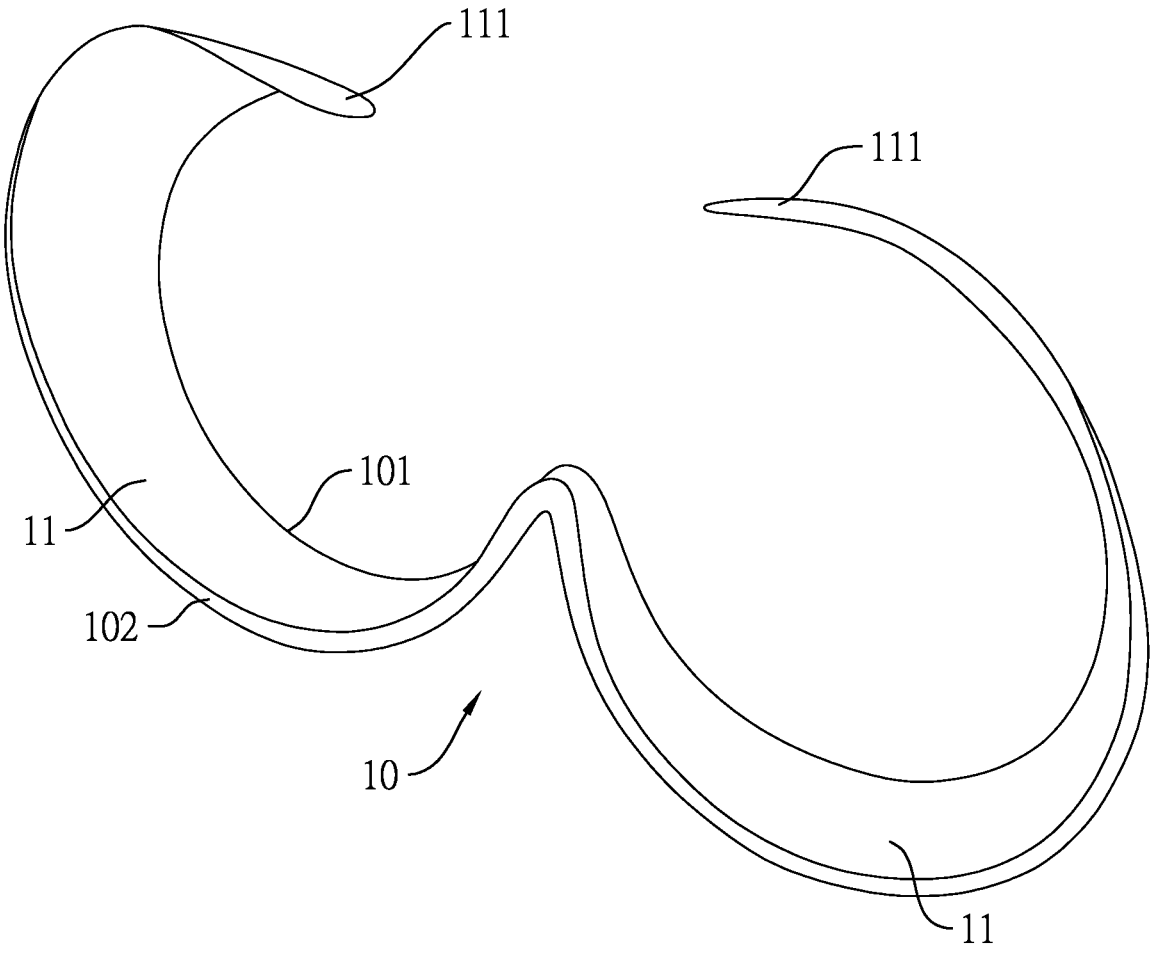
FIG. 2 is a rear perspective view of the breast support in FIG. 1.

With reference to FIGS. 1 and 2, a first preferred embodiment of a breast support in accordance with the present invention is shown. The breast support comprises a supporting bracket 10. The supporting bracket 10 is integrally formed as a single part and has two arc-shaped frame plates 11. Each arc-shaped frame plate 11 has an inner end and an outer end oppositely defined on the arc-shaped frame plate 11. The inner end of one of the arc-shaped frame plates 11 is integrally connected with the inner end of the other one of the arc-shaped frame plates 11, so as to form the supporting bracket 10. The inner ends of the two arc-shaped frame plate 11 form an inverted-V-shaped junction. The outer end of each arc-shaped frame plate 11 bends inwardly to form a holding portion 111.

In addition, each arc-shaped frame plate 11 has a front edge 101 and a rear edge 102. The arc-shaped frame plate 11 extends backwardly and outwardly from the front edge 101 to the rear edge 102. Thus, an opening surrounded by the rear edge 102 is larger than an opening surrounded by the front edge 101 in radius, so that the breast support fits camber of breast of the breast of a human being.

Moreover, the supporting bracket 10 is made of hard and elastic material and is elastic within a proper range of deformation. Specifically, said "hard and elastic material" is relative to "soft and elastic material" such as silicone or sponge, and may be plastic, metal, wood, or the like. Said plastic may be, but is not limited to, polypropylene (PP), polyethylene (PE), polyvinyl chloride (PVC), thermoplastic elastomer (TPE), or the like.

Figure 3:
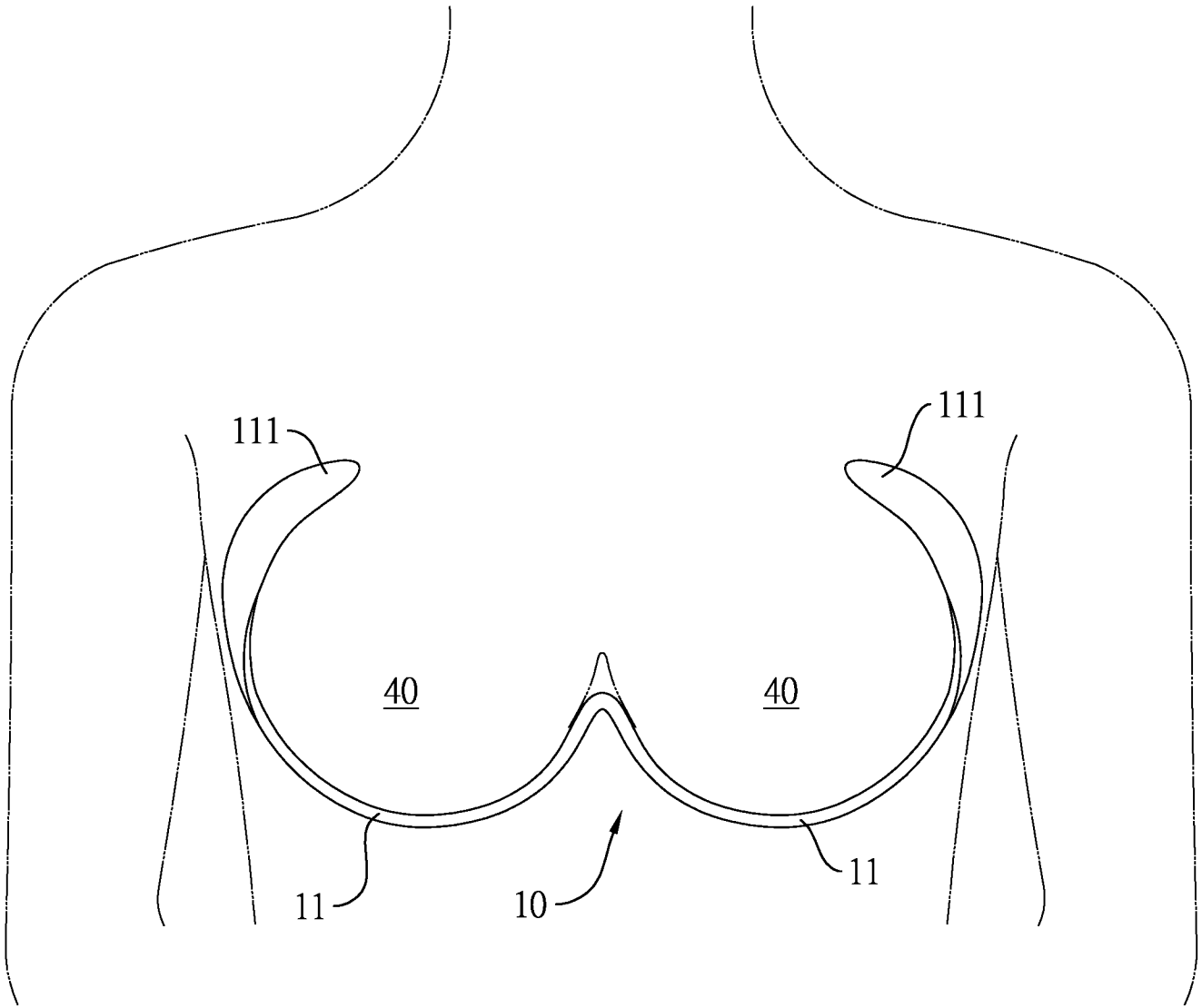
FIG. 3 is an operational front view of the breast support in FIG. 1.

With further reference to FIG. 3, when a wearer wears the breast support of the present invention, the rear edges 102 of the arc-shaped frame plates 11 are positioned toward a chest of the wearer with the arc-shaped frame plates 11 holding lower portions of the two breasts 50 and the inverted-V-shaped junction of the supporting bracket 10 disposed between the two breasts 50. Thus, the two breasts 50 are pushed upward and inward and are held in the arc-shaped frame plates respectively, and the holding portions 111 press on the breasts 50 to allow the breast support to be stably mounted on the breasts 50.

Figure 4:
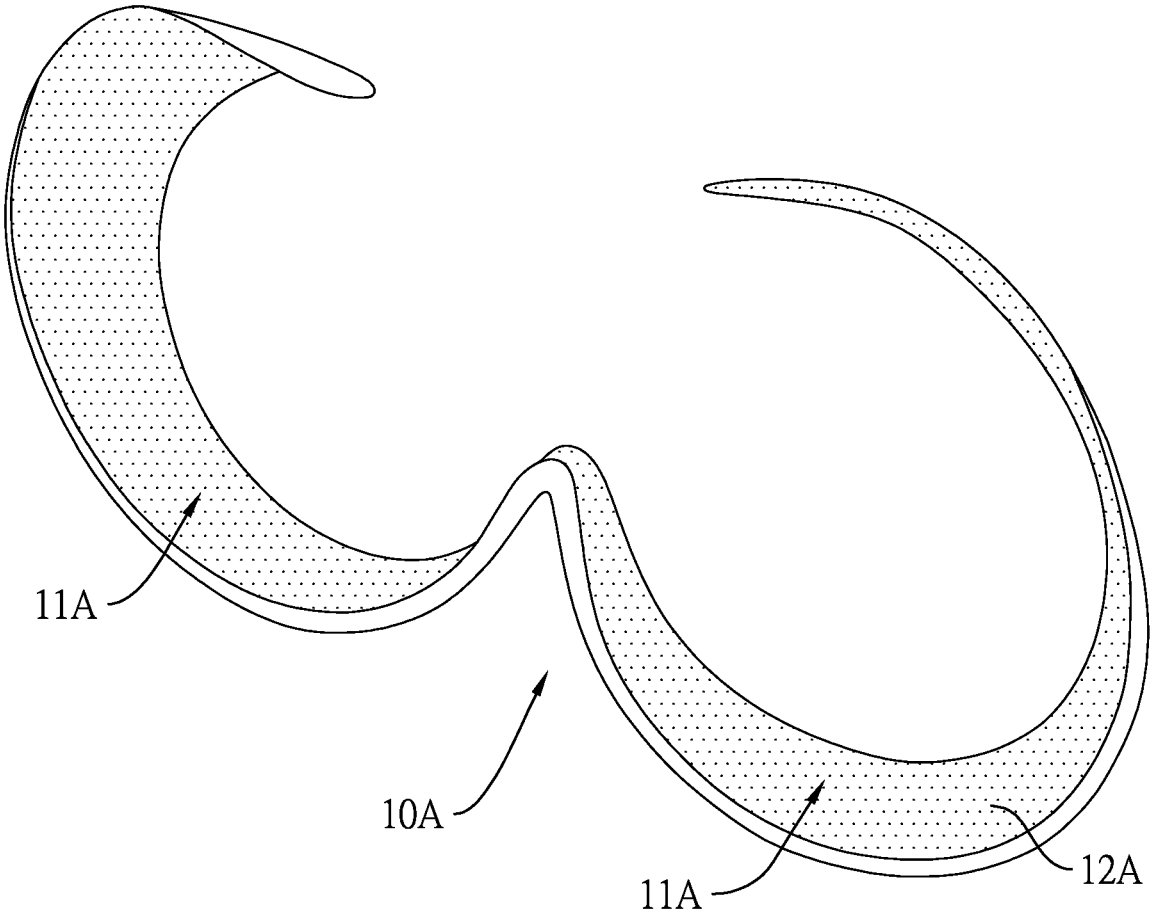
FIG. 4 is a rear perspective view of a second preferred embodiment of a breast support in accordance with the present invention.

With further reference to FIG. 4, a second preferred embodiment of the breast support in accordance with the present invention is shown. In addition to the supporting bracket 10A, the breast support further comprises two anti-slip layers 12A disposed on inner surfaces of the arc-shaped frame plates 11A of the supporting bracket 10A respectively. The anti-slip layers 12A increase friction between the breast support and the breasts 50 of the wearer, such that the breast support is stably mounted on the breast 50 of the wearer. Specifically, the anti-slip layers 12A are made of silicone.

Figure 5:
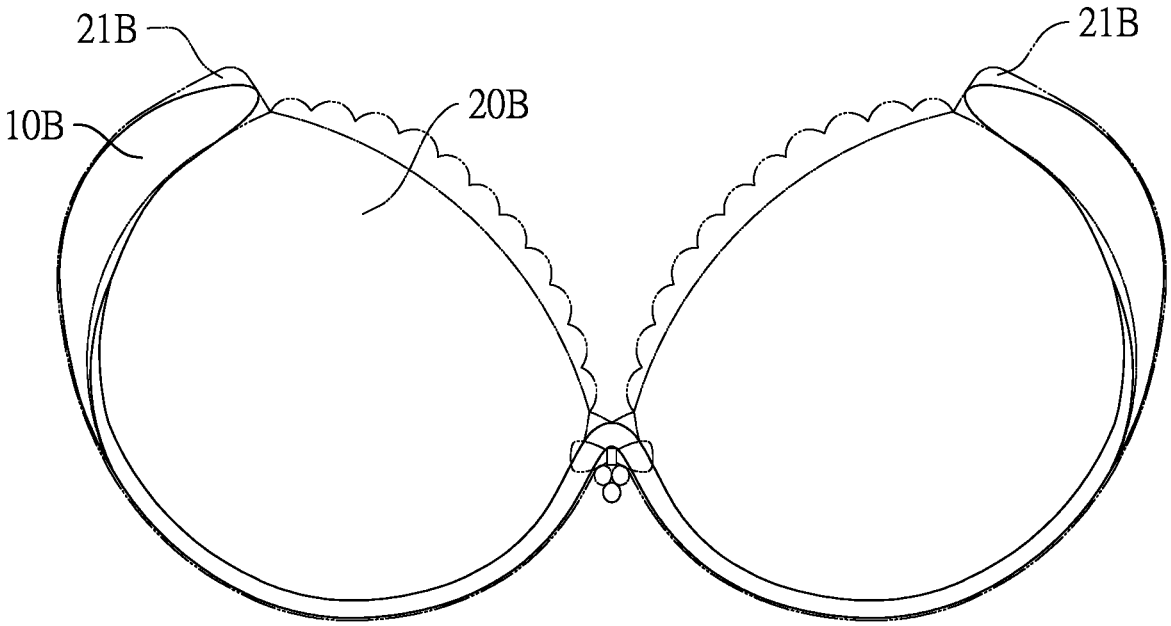
FIG. 5 is a front view of a third preferred embodiment of a breast support in accordance with the present invention.

With further reference to FIG. 5, a third preferred embodiment of the breast support in accordance with the present invention is shown. In addition to the supporting bracket 10B, the breast support further comprises a cup cloth 20B. The cup cloth 20B has two opposite side edges, a lower edge, and a mounting channel 21B. The lower edge of the cup cloth 20B extends between the side edges of the cup cloth 20B. The mounting channel 21B is formed in the cup cloth 20B, and extends along one of the side edges of the cup cloth 20B, the lower edge of the cup cloth 20B and the other one of the side edges of the cup cloth 20B. The supporting bracket 10B is mounted in the mounting channel 21B. Thus, when wearing the third preferred embodiment of the breast support of the present invention, the cup cloth 21B covers the breasts 50 of the wearer.

Figure 6:
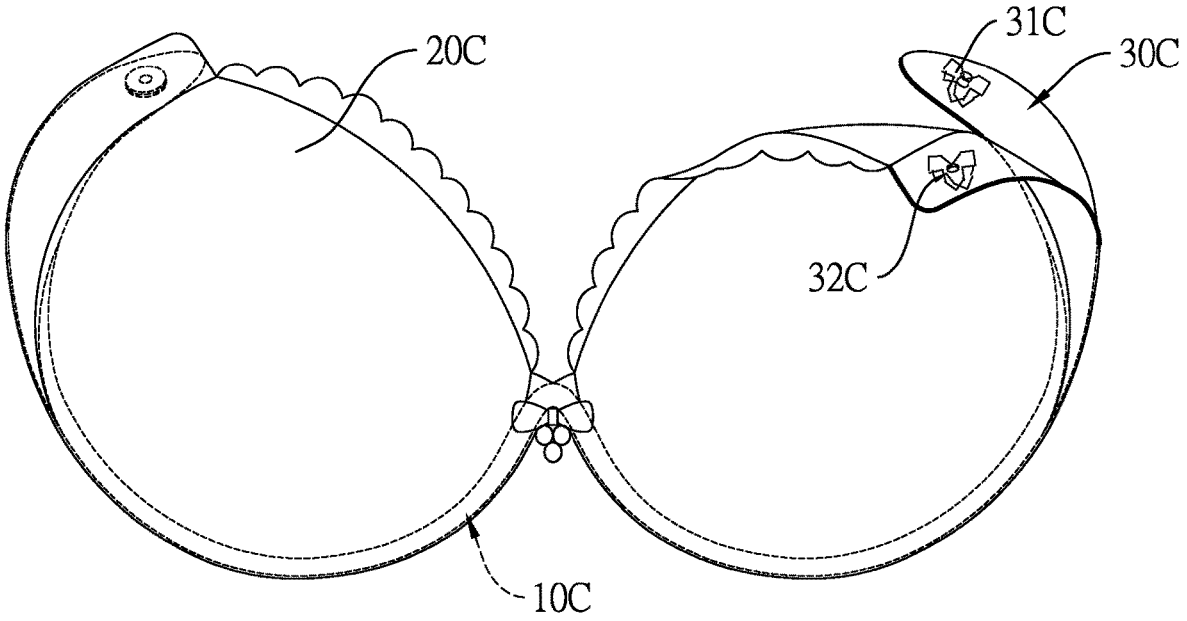
FIG. 6 is a front view of a fourth preferred embodiment of a breast support in accordance with the present invention.
Figure 7:
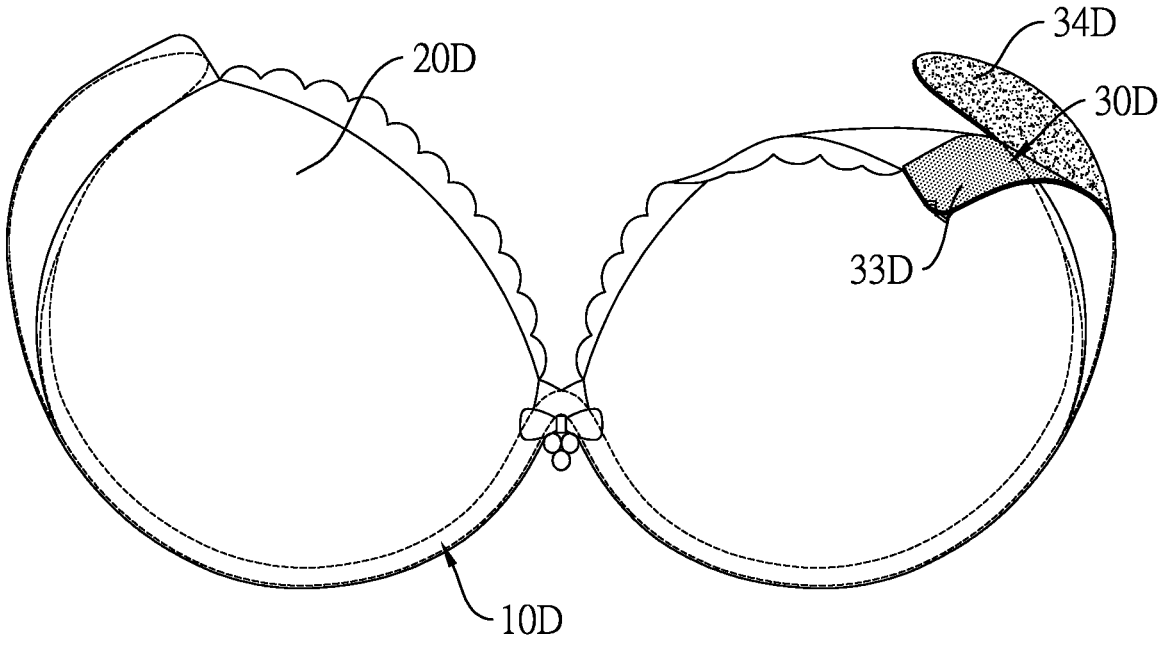
FIG. 7 is a front view of a fifth preferred embodiment of a breast support in accordance with the present invention.

With further reference to FIGS. 6 and 7, a fourth and a fifth preferred embodiments of the breast supports in accordance with the present invention are shown. The cup cloth 20C is detachably attached to the supporting bracket 10C, 10D via at least one fastening assembly 30C, 30D. Each of the at least one fastening assemblies 30C, 30D may be a snap fastener, a hook-and-loop fastener or a magnetic snap fastener. The wearer is able to change the cup cloth 20C, 20D for another style, or the cup cloth 20C, 20D can be detached from the supporting bracket 10C, 10D for washing.

As shown in FIG. 6, in the fourth preferred embodiment of the present invention, the at least one fastening assembly 30C includes multiple fastening assemblies 30C separately disposed along the supporting bracket 10C. Each of the fastening assemblies 30C may be a snap fastener including a stud 31C and a socket 32C. The stud 31C and the socket 32C are securely mounted on one of the arc-shaped frame plates 11C of the supporting bracket 10C and the cup cloth 20C respectively, and correspond in position with each other. Thus, when the stud 31C and the socket 32C of each fastening assembly 30C snap to each other, the cup cloth 20C is assembled onto the supporting bracket 10C. When the cup cloth 20C needs washing or the wearer intends to change the cup cloth 20C for another style, the cup cloth 20C can be detached from the supporting frame 10C easily.

As shown in FIG. 7, in the fifth preferred embodiment of the present invention, each of the at least one fastening assembly 30D may be a hook-and-loop fastener including a hook strip 33D and a loop strip 34D. The hook-and-loop fastener is commonly known as "Velcro strap", and the hook strip 33D and the loop strip 34D are securely mounted on one of the arc-shaped frame plates 11D of the supporting bracket 10D and the cup cloth 20D respectively, and correspond in position with each other. Thus, by attaching the hook strip 33D and the loop strip 34D together, the cup cloth 20D is assembled onto the supporting bracket 10D. When the cup cloth 20D needs washing or the wearer intends to change the cup cloth 20D for another style, the cup cloth 20D can be detached from the supporting frame 10D easily.

Figure 8:
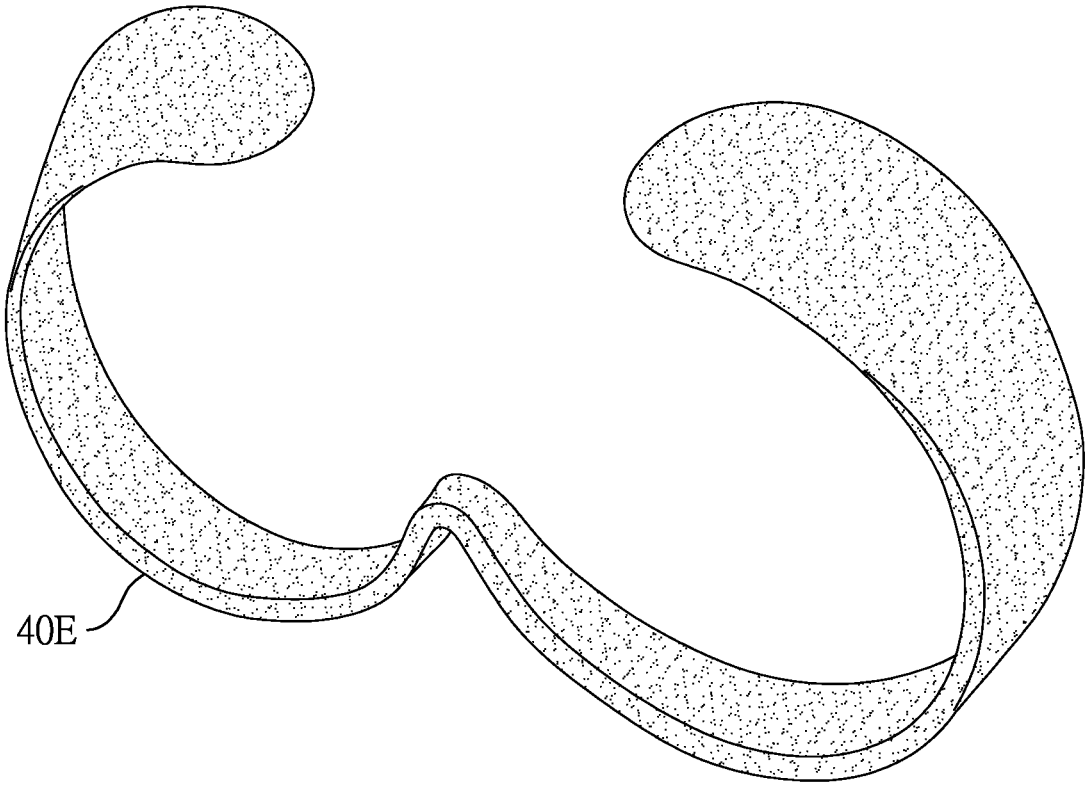
FIG. 8 is a front perspective view of a sixth preferred embodiment of a breast support in accordance with the present invention.
Figure 9:
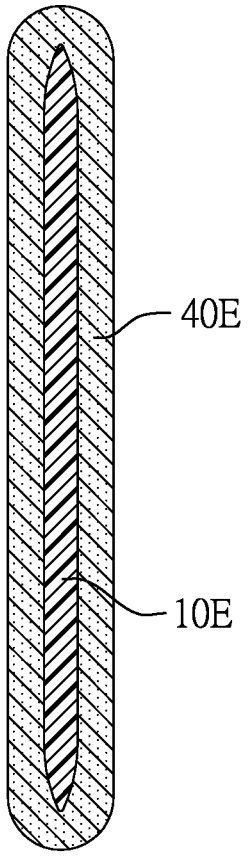
FIG. 9 is a cross-sectional side view of the breast support in FIG. 8.

With further reference to FIGS. 8 and 9, a sixth preferred embodiment of the breast support in accordance with the present is shown. In addition to the supporting bracket 10E, the breast support further comprises a soft cover layer 40E wrapped up the supporting bracket 10E. The soft cover layer 40E may be formed by foamed material or cotton cloth. The soft cover layer 40E not only increases friction between the breasts support and the breasts 50 of the wearer to allow the breast support to be stably worn on the wearer, but also forms a buffer between the supporting bracket 10E and the wearer. Accordingly, comfort while wearing the breast support can be increased.

Figure 10:
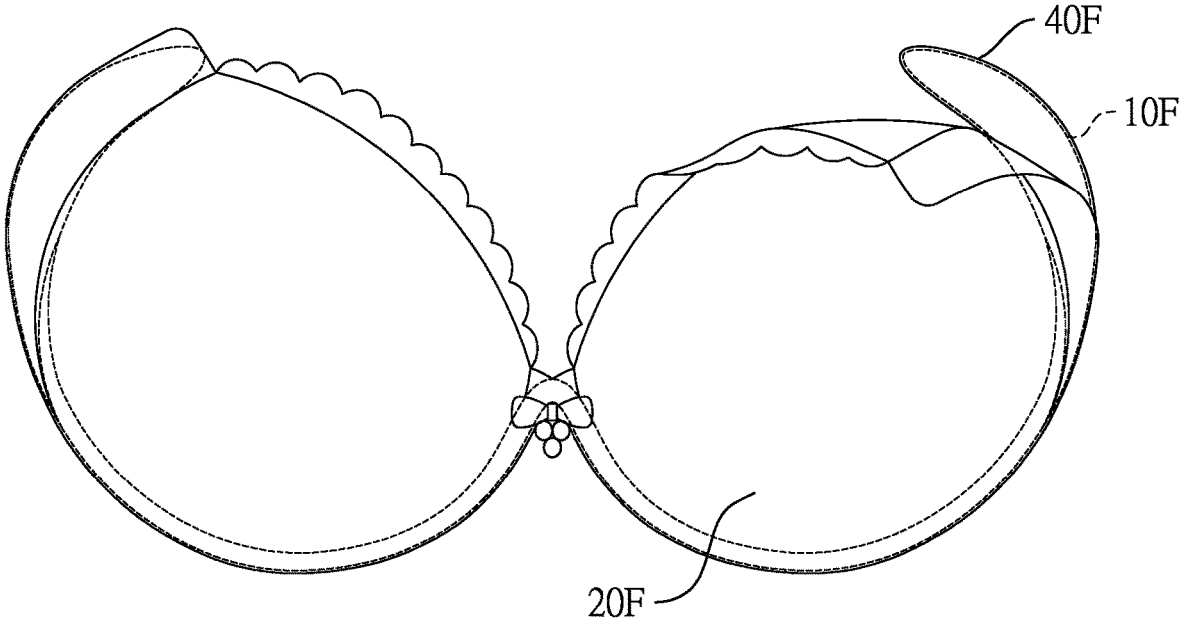
FIG. 10 is a front view of a seventh preferred embodiment of a breast support in accordance with the present invention.
Figure 11:
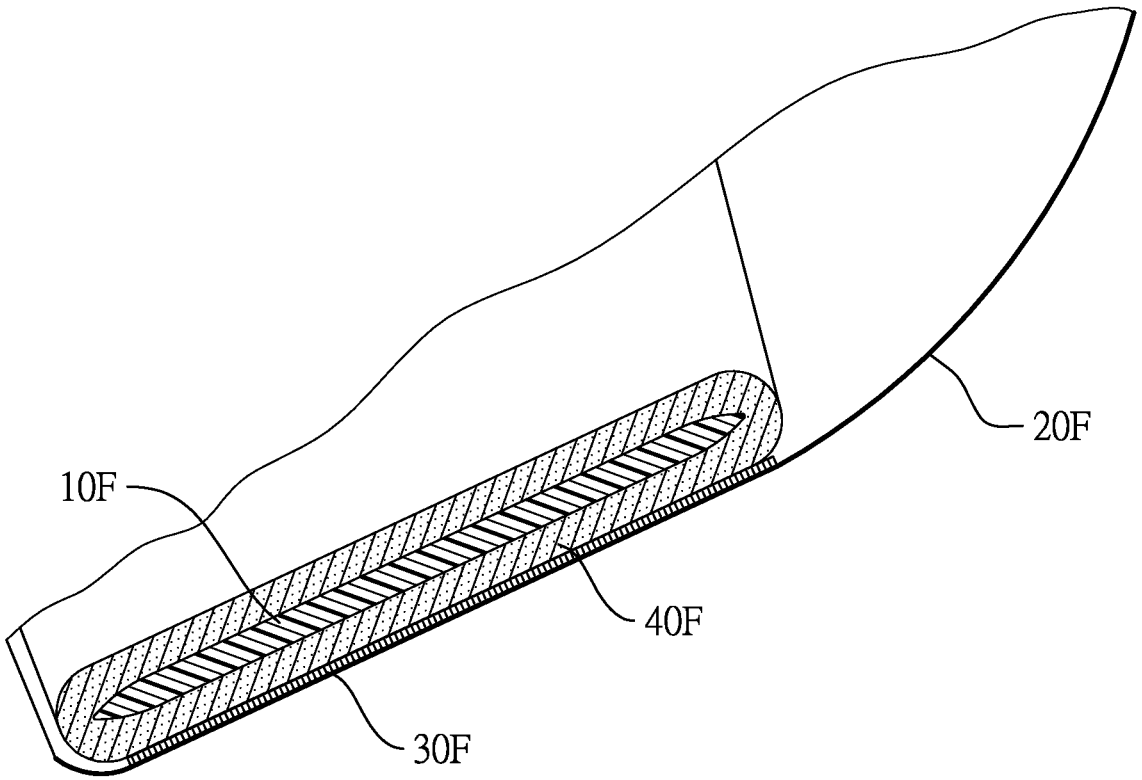
FIG. 11 is a cross-sectional side view of the breast support in FIG. 10.

With further reference to FIGS. 10 and 11, a seventh preferred embodiment of the breast support in accordance with the present invention is shown. The supporting bracket 10F is wrapped by the soft cover layer 40E as described above. Moreover, the cup cloth 20F is detachably attached to the supporting bracket 10F that is wrapped by the soft cover layer 40E via the at least one fastening assembly 30F, such as at least one snap fastener, at least one hook-and-loop fastener or at least one magnetic snap fastener.

Figure 12:
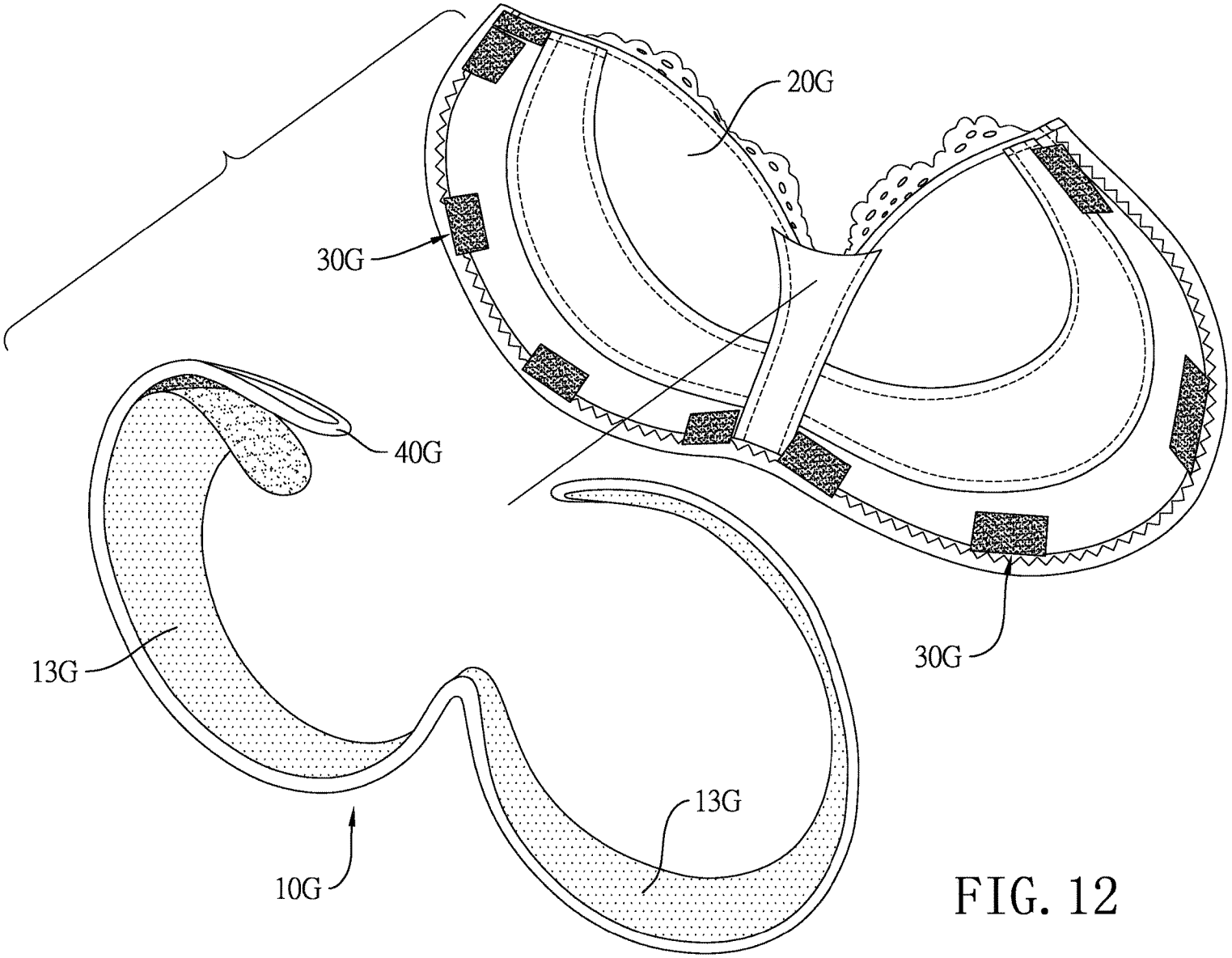
FIG. 12 is an exploded rear perspective view of an eighth preferred embodiment of a breast support in accordance with the present invention.
Figure 13:
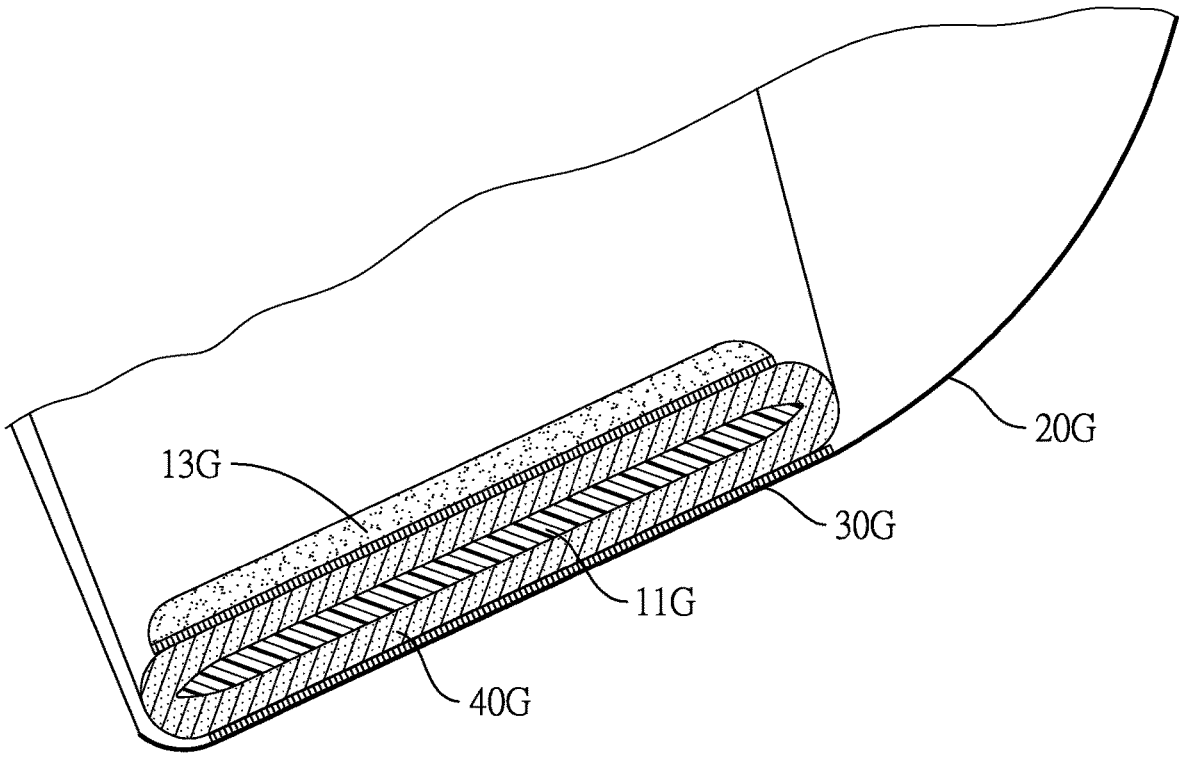
FIG. 13 is a cross-sectional side view of the breast support in FIG. 12.

With further reference to FIGS. 12 and 13, an eighth preferred embodiment of the breast support in accordance with the present invention is shown. The supporting bracket 10G is wrapped by the soft cover layer 40G as described. Moreover, two anti-slip layers 13G are detachably attached to the soft cover layer 40G and correspond in position to the inner surfaces of the two arc-shaped frame plates 11G respectively. Moreover, the cup cloth 20G is detachably attached to the supporting bracket 10G that is wrapped by the soft cover layer 40G via the at least one fastening assembly 30G, such as at least one snap fastener, at least one hook-and-loop fastener or at least one magnetic snap fastener.

The breast support as described has the following advantages. Compared to the conventional invisible bra, contact area between the breast support of the present invention and the breasts 50 of the wearer is greatly reduced. Thus, discomfort due to sweltering and sweating can be avoided. Moreover, the breast support is stably mounted on the chest of the wearer and holds the lower portions of the two breasts 50. Therefore, the breast support does not fall from the wearer due to the loss of stickiness. Accordingly, the breast support of the present invention is able to push the breasts 50 upward and inward and prevents the breasts 50 from expansion and sagging.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A breast support comprising a supporting bracket, the supporting bracket being elastic and integrally formed as a single part, the supporting bracket having two arc-shaped frame plates, each arc-shaped frame plate having an inner end and an outer end oppositely defined on the arc-shaped frame plate, the inner end of one of the arc-shaped frame plates being integrally connected with the inner end of the other one of the arc-shaped frame plates to form the supporting bracket, and the outer end of each arc-shaped frame plate bending inwardly to form a holding portion.

2. The breast support as claimed in claim 1, wherein each arc-shaped frame plate has a front edge and a rear edge, and the arc-shaped frame plate extends backwardly and outwardly from the front edge to the rear edge.

3. The breast support as claimed in claim 1, wherein two anti-slip layers are attached to inner surfaces of the two arc-shaped frame plates of the supporting bracket respectively.

4. The breast support as claimed in claim 2, wherein two anti-slip layers are attached to inner surfaces of the two arc-shaped frame plates of the supporting bracket respectively.

5. The breast support as claimed in claim 1, wherein the breast support further comprises a cup cloth having two opposite side edges;

a lower edge extending between the side edges of the cup cloth; and a mounting channel formed in the cup cloth, and extending along one of the side edges of the cup cloth, the lower edge of the cup cloth and the other one of the side edges of the cup cloth; and the supporting bracket is mounted in the mounting channel.

6. The breast support as claimed in claim 2, wherein the breast support further comprises a cup cloth having two opposite side edges;

a lower edge extending between the side edges of the cup cloth; and a mounting channel formed in the cup cloth, and extending along one of the side edge of the cup cloth, the lower edge of the cup cloth and the other one of the side edges of the cup cloth; and the supporting bracket is mounted in the mounting channel.

7. The breast support as claimed in claim 1 further comprising a cup cloth, and the cup cloth detachably attached to the supporting bracket via at least one fastening assembly.

8. The breast support as claimed in claim 2 further comprising a cup cloth, and the cup cloth detachably attached to the supporting bracket via at least one fastening assembly.

9. The breast support as claimed in claim 7, wherein the at least one fastening assembly includes multiple fastening assemblies separately disposed along the supporting bracket, each of the fastening assemblies is a snap fastener including a stud and a socket, and the stud and the socket are securely mounted on one of the arc-shaped frame plates of the supporting bracket and the cup cloth respectively and correspond in position with each other.

10. The breast support as claimed in claim 8, wherein the at least one fastening assembly includes multiple fastening assemblies separately disposed along the supporting bracket, each of the fastening assemblies is a snap fastener including a stud and a socket, and the stud and the socket are securely mounted on one of the arc-shaped frame plates of the supporting bracket and the cup cloth respectively and correspond in position with each other.

11. The breast support as claimed in claim 7, wherein each of the at least one fastening assembly is a hook-and-loop fastener including a hook strip and a loop strip, and the hook strip and the loop strip are securely mounted on one of the arc-shaped frame plates of the supporting bracket and the cup cloth respectively and correspond in position with each other.

12. The breast support as claimed in claim 8, wherein each of the at least one fastening assembly is a hook-and-loop fastener including a hook strip and a loop strip, and the hook strip and the loop strip are securely mounted on one of the arc-shaped frame plates of the supporting bracket and the cup cloth respectively and correspond in position with each other.

13. The breast support as claimed in claim 1, wherein the breast support further comprises a soft cover layer wrapped up the supporting bracket.

14. The breast support as claimed in claim 2, wherein the breast support further comprises a soft cover layer wrapped up the supporting bracket.

15. The breast support as claimed in claim 13 further comprising a cup cloth, and the cup cloth detachably attached to the supporting bracket via at least one fastening assembly.

16. The breast support as claimed in claim 14 further comprising a cup cloth, and the cup cloth detachably attached to the supporting bracket via at least one fastening assembly.

17. The breast support as claimed in claim 15, wherein two anti-slip layers are detachably attached to the soft cover layer and correspond in position to the inner surfaces of the two arc-shaped frame plates respectively.

18. The breast support as claimed in claim 16, wherein two anti-slip layers are detachably attached to the soft cover layer and correspond in position to the inner surfaces of the two arc-shaped frame plates respectively.

19. The breast support as claimed in claim 15, wherein the at least one fastening assembly includes multiple fastening assemblies separately disposed along the supporting bracket, each of the fastening assemblies is a snap fastener including a stud and a socket, and the stud and the socket are securely mounted on one of the arc-shaped frame plates of the supporting bracket and the cup cloth respectively and correspond in position with each other.

20. The breast support as claimed in claim 15, wherein each of the at least one fastening assembly is a hook-and-loop fastener including a hook strip and a loop strip, and the hook strip and the loop strip are securely mounted on one of the arc-shaped frame plates of the supporting bracket and the cup cloth respectively and correspond in position with each other.

* * * * *